US010495350B2

(12) United States Patent
Kume et al.

(10) Patent No.: US 10,495,350 B2
(45) Date of Patent: Dec. 3, 2019

(54) EJECTOR-TYPE REFRIGERATION CYCLE

(71) Applicant: DENSO CORPORATION, Kariya, Aichi-pref. (JP)

(72) Inventors: Makoto Kume, Kariya (JP); Masahiro Yamada, Kariya (JP); Toshiyuki Tashiro, Kariya (JP); Yoshinori Araki, Kariya (JP); Haruyuki Nishijima, Kariya (JP); Youhei Nagano, Kariya (JP); Yoshiyuki Yokoyama, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 280 days.

(21) Appl. No.: 15/513,508

(22) PCT Filed: Aug. 18, 2015

(86) PCT No.: PCT/JP2015/004096
§ 371 (c)(1),
(2) Date: Mar. 22, 2017

(87) PCT Pub. No.: WO2016/063444
PCT Pub. Date: Apr. 28, 2016

(65) Prior Publication Data

US 2017/0299227 A1 Oct. 19, 2017

(30) Foreign Application Priority Data

Oct. 24, 2014 (JP) ..... 2014-217454

(51) Int. Cl.
*F25B 1/06* (2006.01)
*F25B 6/04* (2006.01)
(Continued)

(52) U.S. Cl.
CPC ..... *F25B 1/06* (2013.01); *F25B 6/04* (2013.01); *F25B 41/00* (2013.01); *F25B 49/02* (2013.01);
(Continued)

(58) Field of Classification Search
CPC .... F25B 1/06; F25B 6/04; F25B 41/00; F25B 49/02; F25B 2341/0012–0014;
(Continued)

(56) References Cited

U.S. PATENT DOCUMENTS 6,477,857 B2 * 11/2002 Takeuchi ..... F25B 9/008 62/191
2004/0255612 A1 * 12/2004 Nishijima ..... F25B 41/00 62/500
(Continued)

FOREIGN PATENT DOCUMENTS

CN 201945081 U 8/2011
JP 2013177879 A 9/2013
(Continued)

OTHER PUBLICATIONS

U.S. Appl. No. 15/513,496, filed Mar. 22, 2017, Tashiro et al.
U.S. Appl. No. 15/513,469, filed Mar. 22, 2017, Araki et al.

*Primary Examiner* — Joseph F Trpisovsky
(74) *Attorney, Agent, or Firm* — Harness, Dickey & Pierce, P.L.C.

(57) ABSTRACT

An ejector-type refrigeration cycle has a compressor, an ejector module, a discharge capacity control section, and a pressure difference determining section. The ejector module has a body providing a gas-liquid separating space. The pressure difference determining section determines whether a low pressure difference operating condition is met. The low pressure difference operating condition is an operating condition in which a pressure difference obtained by subtracting a low-pressure side refrigerant pressure from a
(Continued)

high-pressure side refrigerant pressure a predetermined reference pressure difference or lower. The body is provided with an oil return passage that guides a part of a liquid-phase refrigerant to flow from the gas-liquid separating space to a suction side of the compressor. The discharge capacity control section sets a refrigerant discharge capacity to be a predetermined reference discharge capacity or higher when the low pressure difference operating condition is determined to be met.

2 Claims, 5 Drawing Sheets

(51) Int. Cl.
*F25B 41/00* (2006.01)
*F25B 49/02* (2006.01)

(52) U.S. Cl.
CPC ..... *F25B 2341/0012* (2013.01); *F25B 2341/0014* (2013.01); *F25B 2700/1931* (2013.01); *F25B 2700/2104* (2013.01); *F25B 2700/2106* (2013.01); *F25B 2700/2117* (2013.01)

(58) Field of Classification Search
CPC ..... F25B 2341/0016; F25B 2700/1931; F25B 2700/1933; F25B 2700/195; F25B 2700/197; F25B 2700/2104; F25B 2700/2117; F25B 2700/2106; F25B 2600/0271; F25B 2600/027; F25B 2600/02; F25B 2600/022
USPC ..... 62/500
See application file for complete search history.

(56) References Cited

U.S. PATENT DOCUMENTS

| | | | | |
|---|---|---|---|---|
| 2004/0255613 | A1 | 12/2004 | Choi et al. | |
| 2005/0011221 | A1* | 1/2005 | Hirota ..... | F04B 27/1804 62/500 |
| 2010/0162751 | A1 | 7/2010 | Nishijima et al. | |
| 2015/0033790 | A1 | 2/2015 | Yamada et al. | |
| 2015/0345840 | A1 | 12/2015 | Yokowama et al. | |
| 2016/0200170 | A1 | 7/2016 | Kawamoto et al. | |

FOREIGN PATENT DOCUMENTS

| | | | |
|---|---|---|---|
| WO | WO-2013132769 | A1 | 9/2013 |
| WO | WO-2016063441 | A1 | 4/2016 |

* cited by examiner

EJECTOR-TYPE REFRIGERATION CYCLE

CROSS REFERENCE TO RELATED APPLICATIONS

This application is a U.S. National Phase Application under 35 U.S.C. 371 of International Application No. PCT/JP2015/004096 filed on Aug. 18, 2015 and published in Japanese as WO 2016/063444 A1 on Apr. 28, 2016. This application is based on and claims the benefit of priority from Japanese Patent Application No. 2014-217454 filed on Oct. 24, 2014. The entire disclosures of all of the above applications are incorporated herein by reference.

TECHNICAL FIELD

The present disclosure relates to an ejector-type refrigeration cycle including an ejector as a refrigerant pressure reducer.

BACKGROUND ART

Conventionally, an ejector-type refrigeration cycle that is a vapor compression refrigeration cycle is known to have an ejector as a refrigerant pressure reducer.

In an ordinal refrigeration cycle, a refrigerant evaporating pressure in an evaporator is substantially equal to a pressure of a suction refrigerant drawn into a compressor. In contrast, the ejector-type refrigeration cycle increases the pressure of the suction refrigerant as compared to the ordinal refrigeration cycle. In this way, in the ejector-type refrigeration cycle, it is possible to reduce power consumed by a compressor to thereby enhance a coefficient of performance (i.e., COP) of the cycle.

Patent Literature 1 discloses a gas-liquid separating means integrated ejector with which a gas-liquid separating portion is formed integrally. The ejector will be hereinafter referred to as "ejector module".

According to the ejector module in Patent Literature 1, it is possible to extremely easily form the ejector-type refrigeration cycle by connecting a suction port side of the compressor to a gas-phase refrigerant outflow port from which gas-phase refrigerant separated in the gas-liquid separating portion flows out, connecting a refrigerant inlet side of an evaporator to a liquid-phase refrigerant outflow port from which liquid-phase refrigerant separated in the gas-liquid separating portion flows out, connecting a refrigerant outlet side of the evaporator to a refrigerant suction port, and the like.

PRIOR ART LITERATURES

Patent Literature

Patent Literature 1: JP 2013-177879 A

SUMMARY OF INVENTION

In a general refrigeration cycle device, refrigerant oil for lubricating a compressor is mixed into refrigerant. As this type of refrigerant oil, refrigerant oil compatible with liquid-phase refrigerant is used. In the ejector module in Patent Literature 1, a part of the liquid-phase refrigerant separated in a gas-liquid separating space (i.e., a gas-liquid separating portion) is returned to the suction side of the compressor through an oil return passage to lubricate the compressor.

However, to return the liquid-phase refrigerant separated in the gas-liquid separating space to the suction side of the compressor through the oil return passage, a pressure difference higher than or equal to a predetermined pressure difference is required between a refrigerant pressure in the gas-liquid separating space and a refrigerant pressure on the suction side of the compressor. Therefore, in the ejector module in Patent Literature 1, when the pressure difference between a high-pressure side refrigerant pressure and a low-pressure side refrigerant pressure in the cycle reduces, it may become impossible to return the liquid-phase refrigerant, into which the refrigerant oil is dissolved, to the compressor.

When it is impossible to return the liquid-phase refrigerant in which the refrigerant oil is dissolved to the compressor, it may exert an adverse influence on durability life of the compressor.

With the above points in view, an object of the present disclosure is to provide an ejector-type refrigeration cycle with which a gas-liquid separating space is formed integrally and in which refrigerant oil can be properly returned to a compressor.

An ejector-type refrigeration cycle has a compressor, a radiator, an ejector module, an evaporator, a discharge capacity control section, and a pressure difference determining section. The compressor compresses a refrigerant mixed with a refrigerant oil and discharges the refrigerant. The radiator causes the refrigerant discharged from the compressor to radiate heat. The ejector module has a body that provides a nozzle portion, a refrigerant suction port, a pressure increasing portion, and a gas-liquid separating space. The nozzle portion reduces a pressure of the refrigerant flowing out of the radiator. The refrigerant suction port draws a refrigerant as a suction refrigerant using a suction action of an injection refrigerant jetting out of the nozzle portion at high speed. The pressure increasing portion mixes the injection refrigerant and the suction refrigerant and increases a pressure of the refrigerant. The gas-liquid separating space separates the refrigerant flowing out of the pressure increasing portion into a gas-phase refrigerant and a liquid-phase refrigerant. The evaporator evaporates the liquid-phase refrigerant separated in the gas-liquid separating space. The discharge capacity control section controls a refrigerant discharge capacity of the compressor. The pressure difference determining section determines whether a low pressure difference operating condition is met. The low pressure difference operating condition is defined as an operating condition in which a pressure difference, which is obtained by subtracting a low-pressure side refrigerant pressure in the ejector-type refrigeration cycle from a high-pressure side refrigerant pressure in the ejector-type refrigeration cycle, is equal to or lower than a predetermined reference pressure difference.

The body is provided with an oil return passage that guides a part of the liquid-phase refrigerant, which is separated in the gas-liquid separating space, to flow from the gas-liquid separating space to a suction side of the compressor. The discharge capacity control section sets the refrigerant discharge capacity of the compressor to be higher than or equal to a predetermined reference discharge capacity when the pressure difference determining section determines that the low pressure difference operating condition is met.

According to the features, when the pressure difference determining section determines that the low pressure difference operating condition is met, the discharge capacity control section sets the refrigerant discharge capacity of the compressor to the reference discharge capacity or higher.

Therefore, the pressure difference between the high-pressure side refrigerant pressure and the low-pressure side refrigerant pressure in the ejector-type refrigeration cycle is increased, and thereby a pressure difference between a refrigerant pressure in the gas-liquid separating space and a refrigerant pressure on a suction side of the compressor can be increased.

In addition, the liquid-phase refrigerant, which is separated in the gas-liquid separating space and includes the refrigerant oil, can be returned to the suction side of the compressor through the oil return passage. As a result, a harmful influence on a durability life of the compressor due to a deficiency of the refrigerant oil can be prevented from being caused. Furthermore, according to the present disclosure, it is possible to reliably return the refrigerant oil to the compressor without providing additional components to the conventional ejector-type refrigeration cycle.

The high-pressure side refrigerant pressure in the present disclosure may be a pressure of refrigerant flowing through a refrigerant flow path from a discharge port of the compressor to an inlet of the nozzle portion. The low-pressure side refrigerant pressure may be a pressure of refrigerant flowing through a refrigerant flow path from a liquid-phase refrigerant outflow port of the gas-liquid separating space to the refrigerant suction port.

The reference discharge capacity may be a discharge capacity that enables the liquid-phase refrigerant, which is separated in the gas-liquid separating space and includes the refrigerant oil, to return to the suction side of the compressor through the oil return passage.

When the discharge capacity control section sets the refrigerant discharge capacity of the compressor to the reference discharge capacity or higher, the control section not only continuously sets the refrigerant discharge capacity to the reference discharge capacity or higher but also intermittently sets the refrigerant discharge capacity to the reference discharge capacity or higher, when the pressure difference determining section determines that the low pressure difference operating condition is met.

BRIEF DESCRIPTION OF DRAWINGS

The above and other objects, features and advantages of the present disclosure will become more apparent from the following detailed description made with reference to the accompanying drawings.

DESCRIPTION OF EMBODIMENTS

Embodiments of the present disclosure will be described hereinafter referring to drawings. In the embodiments, a part that corresponds to or equivalents to a matter described in a preceding embodiment may be assigned with the same reference number, and descriptions of the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 1:
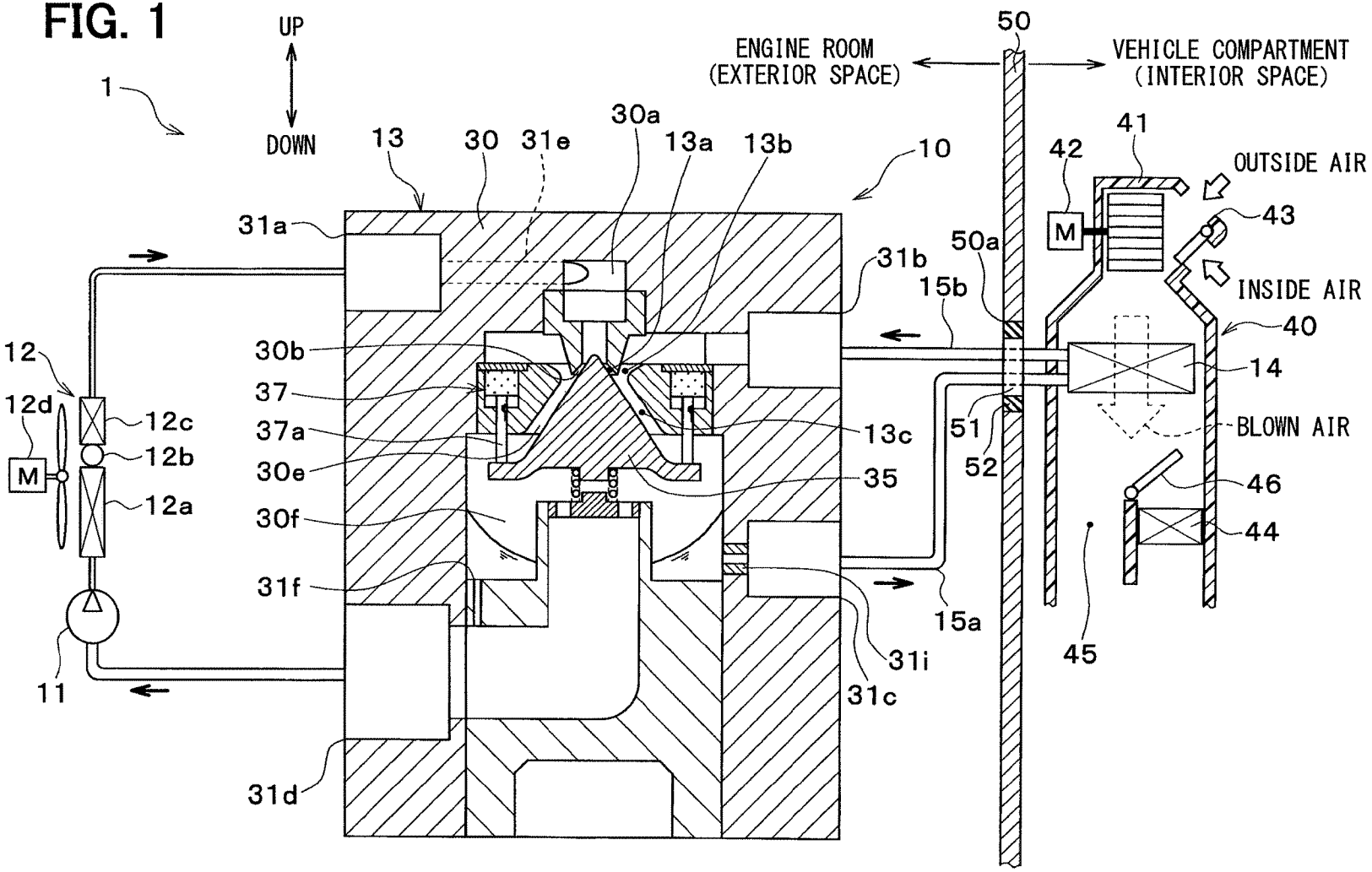
FIG. 1 is a schematic overall configuration diagram illustrating a vehicle air conditioner to which an ejector-type refrigeration cycle according to a first embodiment is applied.

A first embodiment of the present disclosure will be described below with reference to the drawings. An ejector-type refrigeration cycle 10 of the present embodiment illustrated in an overall configuration diagram in FIG. 1 is applied to a vehicle air conditioner 1 and cools a blown air to be blown into a vehicle compartment (i.e., an interior space) which is a space to be air conditioned. Therefore, fluid to be cooled by the ejector-type refrigeration cycle 10 is the blown air.

An HFC refrigerant (specifically, R134a) is employed as refrigerant in the ejector-type refrigeration cycle 10 and the ejector-type refrigeration cycle 10 forms a subcritical refrigeration cycle in which a high-pressure side refrigerant pressure does not exceed a critical pressure. Of course, an HFO refrigerant (specifically, R1234yf) or the like may be employed as refrigerant.

Moreover, refrigerant oil is mixed into the refrigerant for lubricating a compressor 11 and a part of the refrigerant oil circulates in the cycle together with the refrigerant. As the refrigerant oil, refrigerant oil compatible with liquid-phase refrigerant is employed.

In devices forming the ejector-type refrigeration cycle 10, the compressor 11 draws the refrigerant, increases pressure of the refrigerant until the refrigerant becomes high-pressure refrigerant, and discharges the refrigerant. The compressor 11 is disposed in a vehicle engine room together with an internal combustion engine (i.e., an engine) (not illustrated) that outputs a drive force for traveling of the vehicle. The compressor 11 is driven by the rotary drive force output from the engine via a pulley, a belt, or the like.

Specifically, in the present embodiment, a variable capacity compressor with refrigerant discharge capacity which can be adjusted by changing a discharge capacity is employed as the compressor 11. The discharge capacity (i.e., a refrigerant discharge volume) of the compressor 11 is controlled by a control current output from a controller 60 (described later) to a discharge capacity control valve of the compressor 11.

Here, the vehicle engine room of the present embodiment is a space outside the vehicle compartment, in which an engine is housed, and is a space surrounded with a vehicle body, a fire wall 50 (described later), and the like. The vehicle engine room may be referred to as an engine compartment as well in some cases. A refrigerant inflow port of a condensing portion 12*a* of a radiator 12 is connected to a discharge port of the compressor 11.

The radiator 12 is a heat radiating heat exchanger that exchanges heat between the high-pressure refrigerant discharged from the compressor 11 and air (i.e., outside air) outside the vehicle compartment blown by a cooling fan 12*d* to thereby cause the high-pressure refrigerant to radiate heat to cool the refrigerant. The radiator 12 is disposed on a front side in the vehicle engine room with respect to the vehicle.

More specifically, the radiator 12 of the present embodiment is formed as what is called a subcool condenser including the condensing portion 12*a* that exchanges heat between the high-pressure gas-phase refrigerant discharged from the compressor 11 and the outside air blown by the cooling fan 12*d* to thereby cause the high-pressure gas-phase refrigerant to radiate heat to condense the refrigerant, a receiver portion 12*b* that separates the refrigerant flowing out of the condensing portion 12*a* into a gas-phase refrigerant and a liquid-phase refrigerant and stores an excess liquid-phase refrigerant, and a supercooling portion 12*c* that exchanges heat between the liquid-phase refrigerant flowing out of the receiver portion 12*b* and the outside air blown from the cooling fan 12*d* to thereby supercool the liquid-phase refrigerant.

The cooling fan 12*d* is an electric blower a rotation speed (i.e., a blown air amount) of which is controlled by a control voltage output from the controller 60. A refrigerant inflow port 31*a* of an ejector module 13 is connected to a refrigerant outflow port of the supercooling portion 12*c* of the radiator 12.

The ejector module 13 functions as a refrigerant pressure reducer that reduces a pressure of the supercooled high-pressure liquid-phase refrigerant flowing out of the radiator 12 and functions as a refrigerant circulating portion (i.e., a refrigerant transfer portion) that draws (i.e., transfers) the refrigerant flowing out of an evaporator 14 (described later) using a suction action of a refrigerant flow jetted at high speed.

Moreover, the ejector module 13 of the present embodiment has a function of a gas-liquid separating portion that separates the refrigerant, of which pressure is reduced, into the gas-phase refrigerant and the liquid-phase refrigerant.

In other words, the ejector module 13 of the present embodiment is formed as "the ejector integrated with the gas-liquid separating portion" or "the ejector with the gas-liquid separating function". In the present embodiment, in order to clearly differentiate the structure in which the ejector and the gas-liquid separating portion (i.e., a gas-liquid separating space) are integrated with each other (i.e., modularized) from an ejector without a gas-liquid separating portion, the structure will be called by using the term, "ejector module".

The ejector module 13 is disposed in the vehicle engine room together with the compressor 11 and the radiator 12. Upward and downward arrows in FIG. 1 illustrate upward and downward directions in a state in which the ejector module 13 is mounted to the vehicle and upward and downward directions in a state in which other component members are mounted to the vehicle are not limited to the directions in FIG. 1. FIG. 1 illustrates an axial sectional view of the ejector module 13.

More specifically, as illustrated in FIG. 1, the ejector module 13 of the present embodiment includes a body 30 formed by assembling a plurality of component members. The body 30 is formed by a circular columnar metal member. In the body 30, a plurality of refrigerant inflow ports and a plurality of internal spaces are formed.

As the plurality of refrigerant inflow and outflow ports formed in the body 30, specifically, the refrigerant inflow port 31*a*, a refrigerant suction port 31*b*, a liquid-phase refrigerant outflow port 31*c*, and a gas-phase refrigerant outflow port 31*d* are formed. The refrigerant inflow port 31*a* allows the refrigerant flowing out of the radiator 12 to flow into the inside. The refrigerant suction port 31*b* draws the refrigerant flowing out of the evaporator 14. The liquid-phase refrigerant outflow port 31*c* allows the liquid-phase refrigerant separated in a gas-liquid separating space 30*f* formed inside the body 30 to flow out toward a refrigerant inlet side of the evaporator 14. The gas-phase refrigerant outflow port 31*d* allows the gas-phase refrigerant separated in the gas-liquid separating space 30*f* to flow out toward a suction side of the compressor 11.

As the internal spaces formed inside the body 30, a swirling space 30*a*, a pressure reducing space 30*b*, a pressure increasing space 30*e*, the gas-liquid separating space 30*f*, and the like are formed. The swirling space 30*a* swirls the refrigerant flowing in from the refrigerant inflow port 31*a*. The pressure reducing space 30*b* reduces the pressure of the refrigerant flowing out of the swirling space 30*a*. Into the pressure increasing space 30*e*, the refrigerant flowing out of the pressure reducing space 30*b* flows. The gas-liquid separating space 30*f* separates the refrigerant flowing out of the pressure increasing space 30*e* into the gas and the liquid.

The swirling space 30*a* and the gas-liquid separating space 30*f* are formed in shapes of substantially circular columnar rotating bodies. The pressure reducing space 30*b* and the pressure increasing space 30*e* are formed in shapes of substantially truncated cone-shaped rotating bodies gradually expanding from the swirling space 30*a* toward the gas-liquid separating space 30*f*. Central axes of all of these spaces are positioned on the same axis. The shape of the rotating body is a three-dimensional shape formed by a plane figure rotating about a straight line (i.e., a central axis) in the same plane.

Furthermore, the body 30 has a suction passage 13*b* that guides the refrigerant drawn from the refrigerant suction port 31*b* toward a downstream side of a refrigerant flow in the pressure reducing space 30*b*, or an upstream side of a refrigerant flow in the pressure increasing space 30*e*.

A refrigerant inflow passage 31*e* connecting the refrigerant inflow port 31*a* and the swirling space 30*a* extends in a tangential direction of an inner wall surface of the swirling space 30*a* when viewed in an axial direction of the central axis of the swirling space 30*a*. In this way, the refrigerant flowing from the refrigerant inflow passage 31*e* into the swirling space 30*a* flows along the inner wall surface of the swirling space 30*a* and swirls about the central axis of the swirling space 30*a*.

A centrifugal force acts on the refrigerant swirling in the swirling space 30*a*, and thus a refrigerant pressure becomes lower on a central axis side than on an outer peripheral side in the swirling space 30*a*. Therefore, in the present embodiment, the refrigerant pressure on the central axis side in the swirling space 30*a* is reduced to a pressure at which the refrigerant becomes saturated liquid-phase refrigerant or a pressure at which the refrigerant is decompression-boiled during normal operation of the ejector-type refrigeration cycle 10. The pressure at which the refrigerant is decompression-boiled is, in other words, a pressure at which a cavitation occurs.

Adjustment of the refrigerant pressure on the central axis side in the swirling space 30*a* can be achieved by adjusting a swirling flow velocity of the refrigerant swirling in the swirling space 30*a*. The swirling flow velocity can be adjusted by adjusting a ratio between a passage sectional area of the refrigerant inflow passage 31*e* and a vertical sectional area of the swirling space 30*a* in the axial direction, for example. The swirling flow velocity of the present embodiment refers to a flow velocity in a swirling direction of the refrigerant near an outermost peripheral portion in the swirling space 30*a*.

A passage forming member 35 is disposed inside the pressure reducing space 30*b* and the pressure increasing space 30*e*. The passage forming member 35 is formed in a substantially conical shape diverging toward an outer peripheral side as a distance from the pressure reducing space 30*b* increases and a central axis of the passage forming member 35 is disposed coaxially with the central axes of the pressure reducing space 30*b* and the like.

A refrigerant passage is provided between an inner surface of a portion of the body 30, which provides the pressure reducing space 30*b* and the pressure increasing space 30*e*, and a side surface of the passage forming member 35 having a conical shape. The refrigerant passage has an annular shape in cross section perpendicular to the axial direction. The annular shape is, in other words, a doughnut shape obtained by removing a small-diameter circle from a coaxial circle.

In this refrigerant passage, a refrigerant passage formed between the portion of the body 30 forming the pressure reducing space 30*b* and a portion of the conical side surface of the passage forming member 35 on a vertex side is formed in a shape having a passage sectional area reducing toward the downstream side of the refrigerant flow. With this shape, the refrigerant passage forms a nozzle passage 13*a* that functions as a nozzle portion that isentropically reduces the pressure of the refrigerant and jets the refrigerant.

More specifically, the nozzle passage 13*a* of the present embodiment is formed in such a shape that a passage sectional area gradually reduces from an inlet side of the nozzle passage 13*a* toward a smallest passage area portion and gradually increases from the smallest passage area portion toward an outlet side of the nozzle passage 13*a*. In other words, in the nozzle passage 13*a* of the present embodiment, the refrigerant passage sectional area changes similarly to what is called a Laval nozzle.

A refrigerant passage formed between the portion of the body 30 forming the pressure increasing space 30*e* and a portion of the conical side surface of the passage forming member 35 on a downstream side is in such a shape that a passage sectional area gradually increases toward the downstream side of the refrigerant flow. With this shape, the refrigerant passage forms a diffuser passage 13*c* that functions as a diffuser portion (i.e., a pressure increasing portion) that mixes the injection refrigerant jetting out of the nozzle passage 13*a* and the suction refrigerant drawn from the refrigerant suction port 31*b* to increase the pressure of the refrigerant.

An element 37 is disposed inside the body 30 as a drive means that displaces the passage forming member 35 to change the passage sectional area of the smallest passage area portion of the nozzle passage 13*a*.

More specifically, the element 37 has a diaphragm that is displaced according to a temperature and a pressure of the refrigerant flowing through the suction passage 13*b*. The refrigerant flowing through the suction passage 13*b* is the refrigerant flowing out of the evaporator 14. By transmitting the displacement of the diaphragm to the passage forming member 35 by use of actuating rods 37*a*, the passage forming member 35 is displaced in a vertical direction.

Moreover, the element 37 displaces the passage forming member 35 in such a direction (i.e., downward in the vertical direction) as to increase the passage sectional area of the smallest passage area portion as the temperature (degree of superheat) of the refrigerant flowing out of the evaporator 14 increases. On the other hand, the element 37 displaces the passage forming member 35 in such a direction (i.e., upward in the vertical direction) as to reduce the passage sectional area of the smallest passage area portion as the temperature (i.e., degree of superheat) of the refrigerant flowing out of the evaporator 14 reduces.

In the present embodiment, by displacing the passage forming member 35 according to the degree of superheat of the refrigerant flowing out of the evaporator 14 by use of the element 37 in this manner, the passage sectional area of the smallest passage area portion of the nozzle passage 13*a* is adjusted so that the degree of superheat of the refrigerant on an outlet side of the evaporator 14 approaches a predetermined reference degree of superheat.

The gas-liquid separating space 30*f* is disposed below the passage forming member 35. The gas-liquid separating space 30*f* forms a gas-liquid separating portion of a centrifugal separation type that separates the refrigerant into the gas and the liquid by an action of centrifugal force by swirling the refrigerant flowing out of the diffuser passage 13*c* about the central axis.

In the present embodiment, an inner capacity of the gas-liquid separating space 30*f* is set to such a capacity as to be able to store only an extremely small amount of excess refrigerant or substantially no excess refrigerant even when load variation occurs in the cycle and a circulating flow rate of the refrigerant circulating through the cycle changes. Accordingly, the ejector module 13 is entirely downsized.

The body 30 has a portion providing a bottom surface of the gas-liquid separating space 30*f*. The portion is provided with an oil return passage 31*f* that returns the refrigerant oil in the separated liquid-phase refrigerant into a gas-phase refrigerant passage. The gas-phase refrigerant passage connects the gas-liquid separating space 30*f* and the gas-phase refrigerant outflow port 31*d* to each other. The gas-phase refrigerant outflow port 31*d* is connected with a suction port of the compressor 1.

Therefore, the oil return passage 31*f* is the passage that guides a part of the liquid-phase refrigerant, which has been separated in the gas-liquid separating space 30*f* and in which the refrigerant oil is dissolved, from the gas-liquid separating space 30*f* to the suction side of the compressor 11.

On the other hand, an orifice 31*i* as a pressure reducer that reduces the pressure of the refrigerant flowing into the evaporator 14 is disposed in a liquid-phase refrigerant passage connecting the gas-liquid separating space 30*f* and the liquid-phase refrigerant outflow port 31*c*. A refrigerant inflow port of the evaporator 14 is connected to the liquid-phase refrigerant outflow port 31*c* with an inlet pipe 15*a* interposed between the evaporator 14 and the liquid-phase refrigerant outflow port 31*c*.

The evaporator 14 is a heat absorbing heat exchanger that exerts heat absorbing effect by exchanging heat between the low-pressure refrigerant having a pressure reduced in the nozzle passage 13*a* of the ejector module 13 and the blown air to be blown from a blower 42 into the vehicle compartment to thereby evaporate the low-pressure refrigerant. Moreover, the evaporator 14 is disposed in a casing 41 of an interior air conditioning unit 40 (described later).

Here, the vehicle in the present embodiment is provided with the fire wall 50 as a partition plate that separates the vehicle compartment and the vehicle engine room outside the vehicle compartment from each other. The fire wall 50 also has a function of suppressing transfer or transmission of heat, noise, and the like from inside the vehicle engine room to the vehicle compartment and is referred to as a dash panel in some cases.

As illustrated in FIG. 1, the interior air conditioning unit 40 is disposed on a vehicle compartment side of the fire wall 50. Therefore, the evaporator 14 is disposed in the vehicle compartment (i.e., an interior space). The refrigerant suction port 31*b* of the ejector module 13 is connected to a refrigerant outflow port of the evaporator 14 by an outlet pipe 15*b*.

Since the ejector module 13 is disposed in the vehicle engine room (i.e., an exterior space outside the vehicle compartment) as described above, the inlet pipe 15*a* and the outlet pipe 15*b* are disposed so as to pass through the fire wall 50.

More specifically, the fire wall 50 is provided with a through hole 50*a* having a circular or rectangular shape. The vehicle engine room and the vehicle compartment (i.e., the interior space) communicate with each other through the through hole 50*a*. The inlet pipe 15*a* and the outlet pipe 15*b* are connected to a connector 51 which is a metal member for connection to thereby be integrated with each other. The inlet pipe 15*a* and the outlet pipe 15*b* are disposed to pass through the through hole 50*a* with the inlet pipe 15*a* and the outlet pipe 15*b* integrated with each other by the connector 51.

At this time, the connector 51 is positioned on an inner peripheral side of or close to the through hole 50*a*. Packing 52 formed by an elastic member is disposed in a clearance between an outer peripheral side of the connector 51 and an opening edge portion of the through hole 50*a*. In the present embodiment, packing made of ethylene propylene diene monomer rubber (EPDM) which is a rubber material having excellent heat resistance is employed as the packing 52.

By disposing the packing 52 in the clearance between the connector 51 and the through hole 50*a* in this manner, leakage of water, noise, and the like from inside the vehicle engine room into the vehicle compartment through the clearance between the connector 51 and the through hole 50*a* is suppressed.

Next, the interior air conditioning unit 40 will be described. The interior air conditioning unit 40 blows out the blown air, which has been adjusted in temperature by the ejector-type refrigeration cycle 10, into the vehicle compartment and is disposed inside an instrument panel at a most front portion in the vehicle compartment. Moreover, the interior air conditioning unit 40 is formed by putting the blower 42, the evaporator 14, a heater core 44, an air mix door 46, and the like in the casing 41 forming an outer shell of the interior air conditioning unit 40.

The casing 41 forms an air passage for the blown air to be blown into the vehicle compartment and is molded of resin (e.g., polypropylene) with a certain degree of elasticity and excellent strength. On a most upstream side of the blown air flow in the casing 41, an inside/outside air switching device 43 as an inside/outside air switching portion that switches between inside air (i.e., air in the vehicle compartment) and outside air (air outside the vehicle compartment) and introduces the air into the casing 41 is disposed.

The inside/outside air switching device 43 continuously adjusts opening areas of an inside air introducing port for introducing the inside air into the casing 41 and an outside air introducing port for introducing the outside air into the casing 41 by use of an inside/outside air switching door to thereby continuously change a ratio between an air volume of the inside air and an air volume of the outside air. The inside/outside air switching door is driven by an electric actuator for the inside/outside air switching door and actuation of the electric actuator is controlled by control signals output from the controller 60.

The blower 42 as a blower portion that blows air drawn through the inside/outside air switching device 43 into the vehicle compartment is disposed on a downstream side of the inside/outside air switching device 43 in a blown air flow direction. The blower 42 is an electric blower that drives a centrifugal multi-blade fan (i.e., sirocco fan) by an electric motor and a rotation speed (i.e., a volume of blown air) of the blower 42 is controlled by a control voltage output from the controller 60.

The evaporator 14 and the heater core 44 are disposed in this order in the blown air flow direction on a downstream side of the blower 42 in the blown air flow direction. In other words, the evaporator 14 is disposed on the upstream side of the heater core 44 in the blown air flow direction. The heater core 44 is a heating heat exchanger that exchanges heat between engine cooling water and blown air after passage through the evaporator 14 to heat the blown air.

In the casing 41, a cold air bypass passage 45 for allowing the blown air which has passed through the evaporator 14 to detour around the heater core 44 and flow to the downstream side is formed. On the downstream side of the evaporator 14 in the blown air flow direction that is the upstream side of the heater core 44 in the blown air flow direction, the air mix door 46 is disposed.

The air mix door 46 is an air volume ratio adjusting portion that adjusts a radio between a volume of air which passes through the heater core 44 and a volume of air which passes through the cold air bypass passage 45 out of the air after passage through the evaporator 14. The air mix door 46 is driven by an electric actuator that drives the air mix door. Actuation of the electric actuator is controlled by control signals output from the controller 60.

A mixing space for mixing the air which has passed through the heater core 44 and the air which has passed through the cold air bypass passage 45 is provided on the downstream side of the heater core 44 in the air flow direction and the downstream side of the cold air bypass passage 45 in the air flow direction. Therefore, by the adjustment of the air volume ratio by the air mix door 46, a temperature of the blown air (i.e., conditioned air) mixed in the mixing space is adjusted.

Moreover, at a most downstream portion of the casing 41 in the blown air flow direction, opening holes (not illustrated) for blowing out the conditioned air mixed in the mixing space into the vehicle compartment which is the space to be air conditioned are disposed. Specifically, as the opening holes, the surface opening hole that blows out the conditioned air toward an upper body of an occupant in the vehicle compartment, the foot opening hole that blows out the conditioned air toward foot of the occupant, and the defroster opening hole that blows out the conditioned air toward an inner surface of a vehicle windshield are provided.

Downstream sides of the face opening hole, the foot opening hole, and the defroster opening hole in the blown air flow direction are respectively connected to a face blow outlet, a foot blow outlet, and a defroster blow outlet (none of them is illustrated) provided in the vehicle compartment by ducts forming air passages.

A face door that adjusts an opening area of the face opening hole, a foot door that adjusts an opening area of the foot opening hole, and a defroster door that adjusts an opening area of the defroster opening hole (none of them is illustrated) are disposed on upstream sides of the face opening hole, the foot opening hole, and the defroster opening hole in the blown air flow direction, respectively.

The face door, the foot door, and the defroster door form a blowing mode switching portion that switches between blowing modes and are connected to an electric actuator for driving the blowing mode doors by a linkage or the like and rotated in synchronization with each other. Actuation of the electric actuator is also controlled by control signals output from the controller 60.

As the blowing modes, there are a face mode, a bi-level mode, a foot mode, a defroster mode, and the like. In the face mode, the face opening hole is fully opened to blow out the blown air toward the upper body of the occupant. In the bi-level mode, both of the face opening hole and the foot opening hole are opened to blow out the blown air toward the upper body and the foot of the occupant. In the foot mode, the foot opening hole is fully opened and the defroster opening hole is opened to a small degree to blow out the blown air mainly toward the foot of the occupant in the vehicle compartment. In the defroster mode, the defroster opening hole is fully opened to blow out the blown air toward the inner surface of the vehicle windshield.

Figure 2:
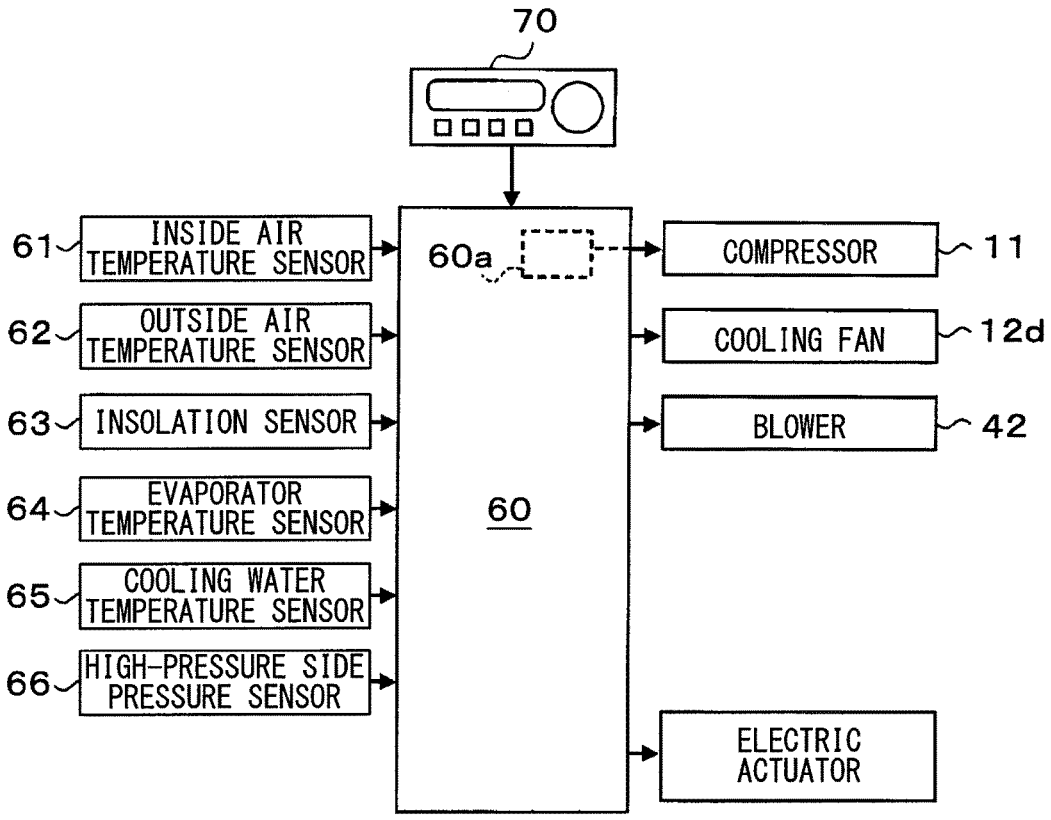
FIG. 2 is a block diagram illustrating an electric control section of the vehicle air conditioner in the first embodiment.

Next, by using FIG. 2, a general outline of an electric control section of the present embodiment will be described. The controller 60 is formed by a known microcomputer including a CPU, a ROM, RAM, and the like and peripheral circuits of the microcomputer. The controller 60 performs various operations and processing based on air conditioning control programs stored in the ROM. The controller 60 controls actuation of the various electric actuators for the compressor 11, the cooling fan 12*d*, the blower 42, and the like connected to an output side of the controller 60.

A group of sensors for air conditioning control such as an inside air temperature sensor 61, an outside air temperature sensor 62, an insolation sensor 63, an evaporator temperature sensor 64, a cooling water temperature sensor 65, and a high-pressure side pressure sensor 66 are connected to the controller 60 and detection values of the group of sensors are input to the controller 60. The inside air temperature sensor 61 detects a temperature (i.e., an inside air temperature) Tr in the vehicle compartment. The outside air temperature sensor 62 is an outside air temperature detector that detects an outside air temperature Tam. The insolation sensor 63 detects an insolation amount As in the vehicle compartment. The evaporator temperature sensor 64 detects a blown-out air temperature (i.e., an evaporator temperature) Tefin of the evaporator 14. The cooling water temperature sensor 65 detects a cooling water temperature Tw of engine cooling water flowing into the heater core 44. The high-pressure side pressure sensor 66 detects pressure (i.e., a high-pressure side refrigerant pressure) Pd of the high-pressure refrigerant discharged from the compressor 11.

Furthermore, an operation panel 70 (not illustrated) disposed near the instrument panel at a front portion in the vehicle compartment is connected to an input side of the controller 60 and operation signals from various operation switches provided to the operation panel 70 are input to the controller 60. As the various operation switches provided to the operation panel 70, an automatic switch, a vehicle compartment temperature setting switch, an air volume setting switch, and the like are provided. The automatic switch sets automatic control operation of the vehicle air conditioner 1. The vehicle compartment temperature setting switch sets the vehicle compartment set temperature Tset. The air volume switch manually sets an air volume of the blower 42.

The controller 60 of the present embodiment is formed by integrally forming control sections that control actuation of various devices which are connected to the output side of the controller 60 and which are to be controlled. In the controller 60, configurations (hardware and software) for controlling actuation of the respective devices to be controlled form the control sections for the respective devices to be controlled.

For example, in the present embodiment, the configuration for controlling the actuation of a discharge capacity control valve of the compressor 11 forms a discharge capacity control section 60*a* for controlling refrigerant discharge capacity of the compressor 11. The discharge capacity control section may be formed by a controller which is a separate body from the controller 60.

Figure 3:
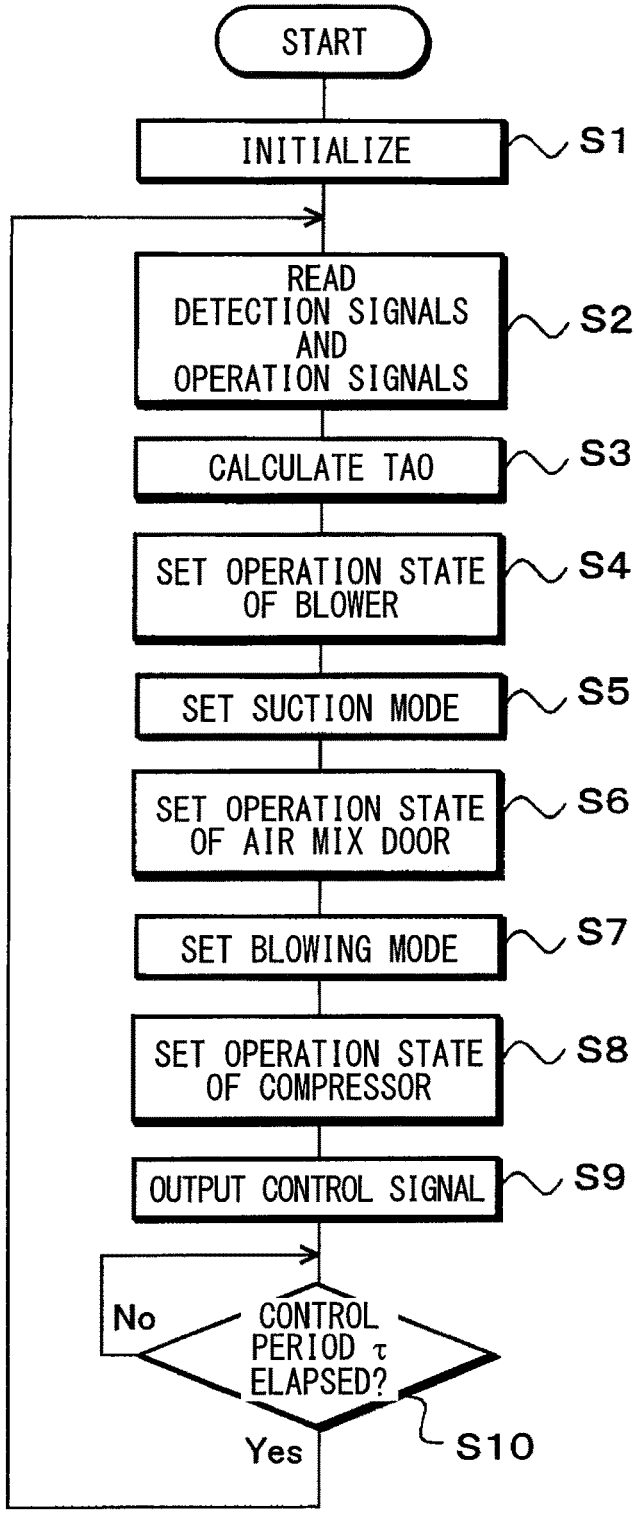
FIG. 3 is a flowchart illustrating control processing of the vehicle air conditioner in the first embodiment.

Next, by using FIGS. 3 and 4, actuation of the vehicle air conditioner 1 in the present embodiment having the above structure will be described. A flowchart in FIG. 3 illustrates control processing of a main routine in an air conditioning control program executed by the controller 60. The air conditioning control program is executed when the automatic switch of the operation panel 70 is thrown (turned on). The control sections in the flowcharts illustrated in FIGS. 3 and 4 form various function implementation sections provided to the controller 60.

First an initialization is performed at 51. In the initialization, a flag, timer, etc. configured by a memory circuit in the controller 60 are initialized, and initial positions of the above-described various electric actuators are set. A value regarding the flag or an operation value, which is memorized when an operation of the vehicle air conditioner 1 was stopped last or when a vehicle system was finished last, is retrieved in the initialization at 51.

Subsequently, detection signals from a group of the sensors 61-66 and operation signals from the operation panel 70 for air conditioning are read in at S2. A target blowing temperature TAO that is a target temperature of the blown air to be blown into the vehicle compartment is calculated at S3 based on the detection signals and the operation signals read in at S2.

Specifically, the target blowing temperature TAO is calculated by the following mathematical expression F1.

$$TAO = Kset \times Tset - Kr \times Tr - Kam \times Tam - Ks \times As + C \quad \text{(F1)}$$

Tset is the vehicle compartment set temperature set by the vehicle compartment temperature setting switch, Tr is a vehicle compartment temperature (i.e., the inside air temperature) detected by the inside air temperature sensor 61, Tam is the outside air temperature detected by the outside air temperature sensor 62, and As is the insolation amount detected by the insolation sensor 63. Kset, Kr, Kam, and Ks are control gains and C is a constant for correction.

Subsequently, at S4 to S8, controlled states of the various devices to be controlled and connected to the controller 60 are determined.

First, the rotation speed (i.e., a blowing capacity) of the blower 42, i.e., the blower motor voltage (i.e., a control voltage) to be applied to the electric motor of the blower 42 is determined at S4 and the control processing proceeds to S5. Specifically, at S4, the blower motor voltage is determined by referring to a control map stored in advance in the controller 60, based on the target blowing temperature TAO determined at S3.

More specifically, the blower motor voltage is determined so as to be a substantially maximum value in an extremely low temperature range (i.e., a maximum cooling range) and an extremely high temperature range (i.e., a maximum heating range) of the target blowing temperature TAO. Furthermore, the blower motor voltage is determined so as to gradually reduce from the substantially maximum value in the extremely low temperature range or the extremely high temperature range toward an intermediate temperature range of the target blowing temperature TAO.

Next, a suction mode, i.e., the control signal to be output to the electric actuator for the inside/outside air switching door is determined at S5 and the control processing proceeds to S6. Specifically, at S5, the suction mode is determined by referring to a control map stored in advance in the controller 60, based on the target blowing temperature TAO.

More specifically, an outside air mode for introducing the outside air is basically selected as the suction mode. When the target blowing temperature TAO is in the extremely low temperature range and high cooling performance is desired, an inside air mode for introducing the inside air is selected.

Next, an opening degree of the air mix door 46, i.e., the control signal to be output to the electric actuator for driving the air mix door is determined at S6 and the control processing proceeds to S7.

Specifically, at S6, the opening degree of the air mix door 46 is calculated based on the target blowing temperature TAO, the evaporator temperature Tefin detected by the evaporator temperature sensor 64, and the cooling water temperature Tw detected by the cooling water temperature sensor 65 so that the temperature of the blown air to be blown into the vehicle compartment approaches the target blowing temperature TAO.

Next, the blowing mode, i.e., the control signal to be output to the electric actuator for driving the blowing outlet mode door is determined at S7 and the control processing proceeds to S8. Specifically, at S7, the blowing mode is determined by referring to a control map stored in advance in the controller 60 based on the target blowing temperature TAO.

More specifically, the blowing mode is switched to the foot mode, the bi-level mode, and the face mode, in this order as the target blowing temperature TAO reduces from the high-temperature range to the low-temperature range.

Next, the refrigerant discharge capacity of the compressor 11, i.e., the control current to be output to the discharge capacity control valve of the compressor 11 is determined at S8 and the control processing proceeds to S9. Details of S8 will be described by using the flowchart in FIG. 4.

Figure 4:
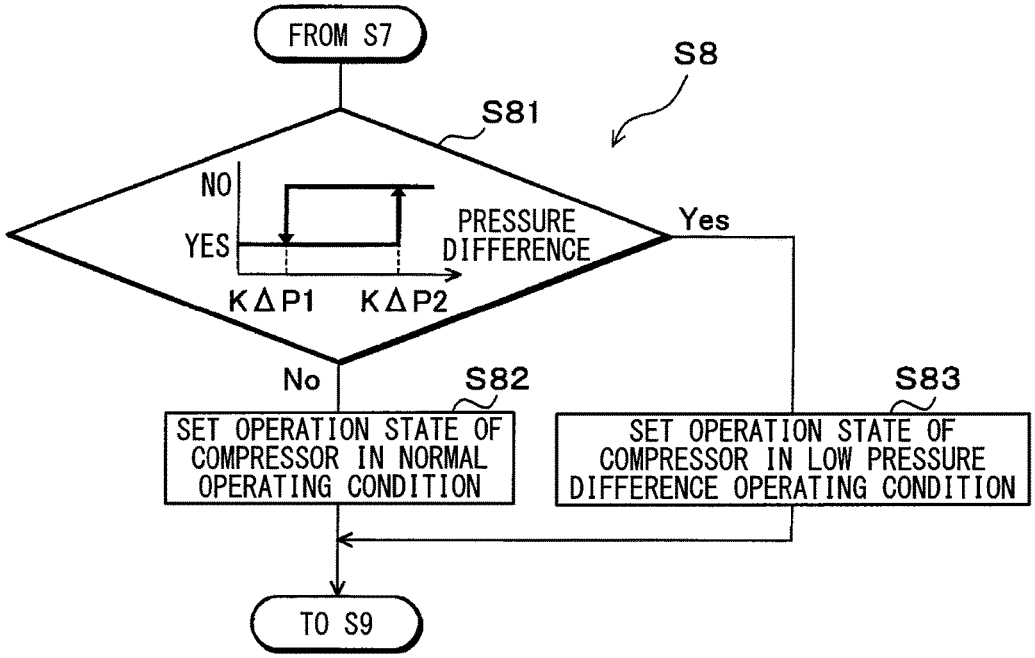
FIG. 4 is a flowchart illustrating a part of the control processing of the vehicle air conditioner in the first embodiment.

In a control section S81 in FIG. 4, it is determined whether a low pressure difference operating condition that a pressure difference ΔP obtained by subtracting the low-pressure side refrigerant pressure Ps from the high-pressure side refrigerant pressure Pd of the cycle is lower than or equal to a predetermined first reference pressure difference KΔP1 is met. Therefore, the control section S81 forms a pressure difference determining section.

The high-pressure side refrigerant pressure Pd of the cycle is the pressure of the refrigerant flowing through the refrigerant flow path from the discharge port of the compressor 11 to the refrigerant inflow port 31*a* of the ejector module 13. In the present embodiment, the high-pressure side refrigerant pressure Pd detected by the high-pressure side pressure sensor 66 is employed. The low-pressure side refrigerant pressure Ps of the cycle is the pressure of the refrigerant flowing through the refrigerant flow path from the liquid-phase refrigerant outflow port 31*c* of the ejector module 13 to the refrigerant suction port 31*b* of the ejector module 13 via the evaporator 14. In the present embodiment, the value determined based on the evaporator temperature Tefin is employed.

Furthermore, in the control section S81 of the present embodiment, as illustrated in a control characteristic diagram in FIG. 4, when it is not determined that the low pressure difference operating condition is met and the pressure difference ΔP becomes equal to or lower than the first reference pressure difference KΔP1 in the decreasing process of the pressure difference ΔP, it is determined that the low pressure difference operating condition is met (Yes) and the control processing proceeds to S83.

On the other hand, when it is determined that the low pressure difference operating condition is met and the pressure difference ΔP becomes equal to or higher than a predetermined second reference pressure difference KΔP2 in the increasing process of the pressure difference ΔP, it is determined that the low pressure difference operating condition is not met (No) and the control processing proceeds to S82. A difference between the first reference pressure difference KΔP1 and the second reference pressure difference KΔP2 is set as a hysteresis width for preventing control hunting.

The refrigerant discharge capacity of the compressor 11 in a normal operating condition, i.e., the control current to be output to the discharge capacity control valve of the compressor 11 is determined at S82 and the control processing proceeds to S9. Specifically, at S82, a target evaporator blowing temperature TEO of the evaporator 14 is determined by referring to a control map stored in advance in the controller 60 based on the target blowing temperature TAO.

Based on a deviation of the evaporator temperature Tefin detected by the evaporator temperature sensor from the target evaporator blowing temperature TEO, the control current to be output to the discharge capacity control valve of the compressor 11 is determined so that the evaporator temperature Tefin approaches the target evaporator blowing temperature TEO by use of a feedback control method.

On the other hand, the refrigerant discharge capacity of the compressor 11 in the low pressure difference operating condition is determined at S82 and the control processing proceeds to S9. Specifically, at S82, the control current to be output to the discharge capacity control valve of the compressor 11 is determined so that the refrigerant discharge capacity of the compressor 11 becomes equal to or higher than the reference discharge capacity.

Here, in the ejector-type refrigeration cycle 10 of the present embodiment, a part of the liquid-phase refrigerant separated in the gas-liquid separating space 30*f* of the ejector module 13 is led to the suction side of the compressor 11 through the oil return passage 31*f*. In this way, the refrigerant oil dissolved in the liquid-phase refrigerant is returned to the compressor 11 to lubricate the compressor 11.

In order to return the liquid-phase refrigerant separated in the gas-liquid separating space 30*f* to the suction side of the compressor 11 through the oil return passage 31*f* in this manner, a pressure difference between a refrigerant pressure in the gas-liquid separating space 30*f* and a refrigerant pressure on the suction side of the compressor 11 needs to be equal to or higher than a predetermined value. Therefore, in the low pressure difference operating condition with the small pressure difference ΔP, it may be impossible to return the liquid-phase refrigerant separated in the gas-liquid separating space 30*f* to the compressor 11.

Therefore, in the present embodiment, a value with which the liquid-phase refrigerant separated in the gas-liquid separating space 30*f* can be reliably returned to the suction side of the compressor 11 is employed as the first reference pressure difference KΔP1. Furthermore, the refrigerant discharge capacity with which the liquid-phase refrigerant separated in the gas-liquid separating space 30*f* can be reliably returned to the suction side of the compressor 11, i.e., the refrigerant discharge capacity with which the pressure difference ΔP becomes equal to or higher than the first reference pressure difference KΔP1 is employed as the reference discharge capacity.

Next, at S9 illustrated in FIG. 3, the control signals and the control voltages are output from the controller 60 to the various devices, which are target devices to be controlled and connected to the output side of the controller 60, so as to obtain the controlled states determined at S4 to S8 described above. In succeeding S10, when it is determined that a control period τ has elapsed after the control period τ has been waited for, the control processing returns to S2.

In other words, in the air conditioning control program executed by the controller 60, reading in of the detection signals and the operation signals, determination of the controlled states of the respective devices to be controlled, and output of the control signals and the control voltages to the respective devices to be controlled are repeated until stop of actuation of the vehicle air conditioner 1 is requested. By execution of the air conditioning control program, the refrigerant flows as illustrated by thick solid arrows in FIG. 1 in the ejector-type refrigeration cycle 10.

In other words, the high-temperature high-pressure refrigerant discharged from the compressor 11 flows into the condensing portion 12*a* of the radiator 12. The refrigerant which has flowed into the condensing portion 12*a* exchanges heat with the outside air blown from the cooling fan 12*d*, radiates heat, and condenses. The refrigerant which has condensed in the condensing portion 12*a* is separated into gas-phase refrigerant and liquid-phase refrigerant in the receiver portion 12*b*. The liquid-phase refrigerant obtained by the gas-liquid separation in the receiver portion 12*b* exchanges heat with the outside air blown from the cooling fan 12*d* in the supercooling portion 12*c* and further radiates heat to become the supercooled liquid-phase refrigerant.

The supercooled liquid-phase refrigerant flowing out of the supercooling portion 12*c* of the radiator 12 is isentropically reduced in pressure and jetted in the nozzle passage 13*a* formed between the inner peripheral surface of the pressure reducing space 30*b* of the ejector module 13 and the outer peripheral surface of the passage forming member 35. At this time, the refrigerant passage area of the smallest passage area portion of the pressure reducing space 30*b* is adjusted so that the degree of superheat of the refrigerant on the outlet side of the evaporator 14 approaches the reference degree of superheat.

Using a suction action of the injection refrigerant jetting out of the nozzle passage 13*a*, the refrigerant flowing out of the evaporator 14 is drawn from the refrigerant suction port 31*b* into the ejector module 13. The injection refrigerant jetting out of the nozzle passage 13*a* and the suction refrigerant drawn through the suction passage 13*b* flow into the diffuser passage 13*c* and join each other.

In the diffuser passage 13*c*, due to the increase in the refrigerant passage area, kinetic energy of the refrigerant is converted into pressure energy. In this way, while the injection refrigerant and the suction refrigerant are mixed, the pressure of the mixed refrigerant increases. The refrigerant flowing out of the diffuser passage 13*c* is separated into the gas and the liquid in the gas-liquid separating space 30*f*. The liquid-phase refrigerant separated in the gas-liquid separating space 30*f* is reduced in pressure in the orifice 31*i* and flows into the evaporator 14.

The refrigerant which has flowed into the evaporator 14 absorbs heat from the blown air blown by the blower 42 and evaporates. As a result, the blown air is cooled. On the other hand, the gas-phase refrigerant separated in the gas-liquid separating space 30*f* flows out of the gas-phase refrigerant outflow port 31*d* and is drawn into the compressor 11 and compressed again.

The blown air cooled in the evaporator 14 flows into a ventilation path on the heater core 44 side and the cold air bypass passage 45 depending on the opening degree of the air mix door 46. The cold air which has flowed into the ventilation path on the heater core 44 side is reheated when the cold air passes through the heater core 44 and mixed with the cold air, which has passed through the cold air bypass passage 45, in the mixing space. The conditioned air adjusted in temperature in the mixing space is blown out of the mixing space into the vehicle compartment through respective blow outlets.

As described above, according to the vehicle air conditioner 1 of the present embodiment, it is possible to air-condition the vehicle compartment. Moreover, according to the ejector-type refrigeration cycle 10 of the present embodiment, the refrigerant which has been increased in pressure by the diffuser passage 13*c* is drawn into the compressor 11 and therefore it is possible to reduce power for driving the compressor 11 to thereby enhance the efficiency (i.e., the COP) of the cycle.

Furthermore, in the ejector module 13 of the present embodiment, by swirling the refrigerant in the swirling space 30*a*, the refrigerant pressure on the swirling center side in the swirling space 30*a* is reduced to the pressure at which the refrigerant becomes the saturated liquid-phase refrigerant or the pressure at which the refrigerant boils under reduced pressure. In other words, the pressure at which the refrigerant boils under reduced pressure is a pressure at which the cavitation occurs. The gas-liquid two-phase refrigerant with much gas-phase refrigerant existing on the swirling center side is caused to flow into the nozzle passage 13*a*.

In this way, wall surface boiling due to friction between the refrigerant and wall surfaces of the nozzle passage 13*a* and interface boiling due to a boiling core caused by cavitation of the refrigerant on the swirling center side can facilitate boiling of the refrigerant in the nozzle passage 13*a*. As a result, it is possible to improve energy conversion efficiency in converting the pressure energy of the refrigerant into velocity energy by the nozzle passage 13*a*.

According to the ejector-type refrigeration cycle 10 of the present embodiment, when it is determined that the low pressure difference operating condition is met in the control section S81 forming the pressure difference determining section, the discharge capacity control section 60*a* of the controller 60 sets the refrigerant discharge capacity of the compressor 11 to equal to or higher than reference discharge capacity.

Therefore, it is possible to increase the pressure difference ΔP between the high-pressure side refrigerant pressure Pd and the low-pressure side refrigerant pressure Ps, to thereby increase the pressure difference between the refrigerant pressure in the gas-liquid separating space 30*f* and the refrigerant pressure on the suction side of the compressor 11. As a result, it is possible to reliably return the liquid-phase refrigerant which has been separated in the gas-liquid separating space 30*f* and in which the refrigerant oil is dissolved, to the suction side of the compressor 11 through the oil return passage 31*f*.

It is possible to suppress an adverse influence exerted by the insufficient refrigerant oil on durability life of the compressor 11. Furthermore, in the ejector-type refrigeration cycle 10 of the present embodiment, it is possible to reliably return the refrigerant oil to the compressor 11 without providing additional component parts to the conventional ejector-type refrigeration cycle.

Second Embodiment

In the present embodiment, an example in which a control mode of the control section S81 forming the pressure difference determining section is changed will be described. In the control section S81 of the present embodiment, it is determined whether a low pressure difference operating condition is met by using an outside air temperature Tam detected by the outside air temperature sensor 62.

Here, during dehumidification heating operation performed at a low outside air temperature, performance required for an ejector-type refrigeration cycle 10 to cool blown air is low and a heat load on the ejector-type refrigeration cycle 10 is small. Therefore, refrigerant discharge capacity of a compressor 11 decreases and a pressure difference ΔP between a high-pressure side refrigerant pressure Pd and a low-pressure side refrigerant pressure Ps of the cycle is liable to decrease.

Figure 5:
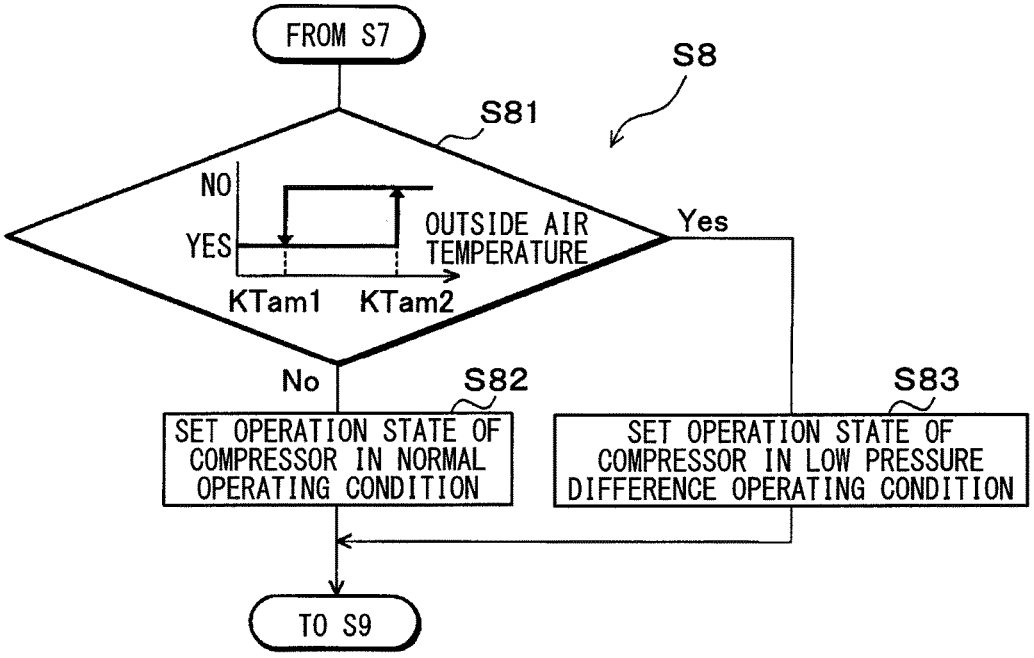
FIG. 5 is a flowchart illustrating a part of control processing of a vehicle air conditioner in a second embodiment.

Therefore, in the present embodiment, as illustrated in a control characteristic diagram in FIG. 5, when it is not determined that the low pressure difference operating condition is met and the outside air temperature Tam becomes equal to or lower than a predetermined first reference outside air temperature KTam1 in a decreasing process of the outside air temperature Tam, it is determined that the low pressure difference operating condition is met (Yes) and control processing proceeds to S83.

On the other hand, when it is determined that the low pressure difference operating condition is met and the outside air temperature Tam becomes equal to or higher than a predetermined second reference outside air temperature KTam2 in an increasing process of the outside air temperature Tam, it is determined that the low pressure difference operating condition is not met (No) and the control processing proceeds to S82.

The first reference outside air temperature KTam1 is set to such a temperature that the pressure difference ΔP becomes equal to a first reference pressure difference KΔP described in the first embodiment, when the dehumidification heating operation is performed in a case where the outside air temperature Tam is equal to or lower than the first reference outside air temperature KTam1. A difference between the first reference outside air temperature KTam1 and the second reference outside air temperature Ktam2 is set as a hysteresis width for preventing control hunting.

Other structures and actuation of a vehicle air conditioner 1 are similar to those in the first embodiment. Therefore, with the vehicle air conditioner 1 in the present embodiment, it is possible to achieve air conditioning in a vehicle compartment similarly to the first embodiment. Moreover, according to the ejector-type refrigeration cycle 10 of the present embodiment, similarly to the first embodiment, it is possible to reliably return liquid-phase refrigerant which has been separated in a gas-liquid separating space 30*f* and in which refrigerant oil is dissolved, to a suction side of the compressor 11 through the oil return passage 31*f*.

Other Modifications

It should be understood that the present disclosure is not limited to the above-described embodiments and intended to cover various modification within a scope of the present disclosure as described hereafter.

(1) In the example described in each of the above-described embodiments, the discharge capacity control section 60*a* continuously sets the refrigerant discharge capacity of the compressor 11 to the reference discharge capacity or higher when it is determined that the low pressure difference operating condition is met in the control section S81 forming the pressure difference determining section. However, a control mode of the discharge capacity control section 60*a* is not limited to that in each of the above-described embodiments.

Figure 6:
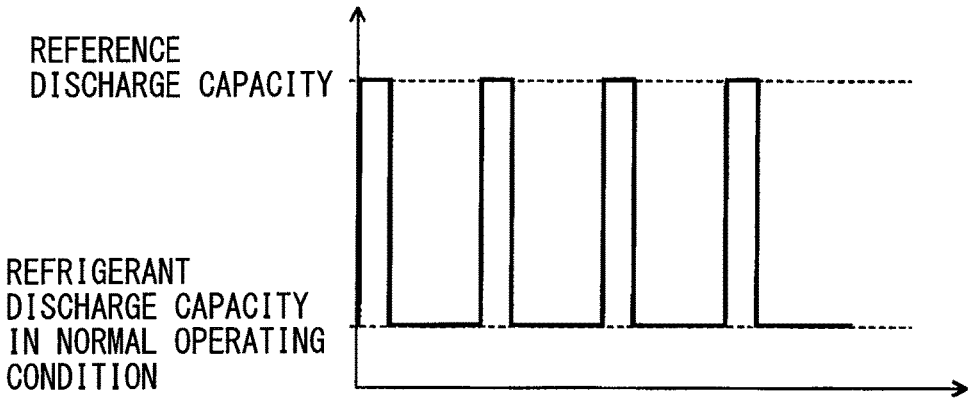
FIG. 6 is a time chart illustrating change in refrigerant discharge capacity of a compressor in a low pressure difference operating condition in another embodiment.

For example, refrigerant discharge capacity may be controlled to intermittently become equal to or higher than reference discharge capacity. For lubrication of the compressor 11, it is unnecessary to continuously supply refrigerant oil to a sliding portion of the compressor 11 and it suffices to periodically supply the refrigerant oil so that an oil film on the sliding portion does not break. Therefore, as illustrated in a time chart in FIG. 6, it is possible to perform the control so that the refrigerant discharge capacity of the compressor in the low pressure difference operating condition periodically intermittently becomes equal to or higher than the reference discharge capacity.

(2) In the example described in the above-described first embodiment, the value determined based on the evaporator temperature Tefin is employed as the low-pressure side refrigerant pressure Ps of the cycle. However, a low-pressure side pressure sensor that detects a pressure (low-pressure side refrigerant pressure Ps) of refrigerant on an outlet side of the evaporator 14 may be provided and it may be determined whether a low pressure difference operating condition is met in the control section S81 by using the low-pressure side refrigerant pressure Ps detected by the low-pressure side pressure sensor.

(3) The devices forming the ejector-type refrigeration cycle 10 are not restricted to those disclosed in the above-described embodiments.

For example, in the example described in each of the above-described embodiments, the variable capacity compressor is employed as the compressor 11. However, the compressor 11 is not restricted to the variable capacity compressor. As the compressor 11, a fixed capacity compressor that is driven by a rotary drive force output from an engine via an electromagnetic clutch, a belt, or the like may be employed.

When the fixed capacity compressor is employed, an operating rate of the compressor may be changed by engagement and disengagement of the electromagnetic clutch to adjust refrigerant discharge capacity. In other words, at S83, the operating rate of the compressor may be increased so that the refrigerant discharge capacity of the compressor becomes equal to or higher than reference discharge capacity.

Furthermore, an electric compressor with refrigerant discharge capacity adjusted by changing a rotation speed of an electric motor may be employed as the compressor 11. When the electric compressor is employed, the rotation speed of the electric motor may be changed to adjust refrigerant discharge capacity. In other words, at S83, the rotation speed of the electric motor may be increased so that the refrigerant discharge capacity of the compressor becomes equal to or higher than reference discharge capacity.

In the example described in each of the above-described embodiments, the subcool heat exchanger is employed as the radiator 12. However, a normal radiator formed by only the condensing portion 12*a* may be employed and a liquid receiver (i.e., a receiver) that separates refrigerant, which has radiated heat in the radiator, into gas-phase refrigerant and liquid-phase refrigerant to store an excess liquid-phase refrigerant may be employed as well as the normal radiator.

Moreover, the component members forming the ejector module 13 are not restricted to those disclosed in the above-described embodiments. For example, the component members such as the body 30 and the passage forming member 35 of the ejector module 13 are not restricted to those made of metal but may be members made of resin.

Furthermore, in the example described in each of the above-described embodiments, the ejector module 13 is provided with the orifice 31*i*. However, the orifice 31*i* may not be provided and a pressure reducer may be disposed in the inlet pipe 15*a*. As the pressure reducer, an orifice, a capillary tube, or the like may be employed.

(4) In the example described in each of the above-described embodiments, the ejector module 13 is disposed in the vehicle engine room. However, the ejector module 13 may be disposed on a vehicle compartment side of the fire wall 50.

Furthermore, the ejector module 13 may be disposed on an inner peripheral side of the through hole 50*a* in the fire wall 50. In this case, a part of the ejector module 13 is disposed on a vehicle engine room side and another part is disposed on a vehicle compartment side. Therefore, it is preferable to dispose packing having a similar function as that in the first embodiment in a clearance between an outer periphery of the ejector module 13 and an opening edge portion of the through hole 50*a*.

(5) In the example described in each of the above-described embodiments, the ejector-type refrigeration cycle 10 according to the present disclosure is applied to the vehicle air conditioner 1. However, the ejector-type refrigeration cycle 10 according to the present disclosure is not restricted to that applied to the vehicle air conditioner 1. For example, the ejector-type refrigeration cycle 10 may be applied to a refrigeration device for a vehicle. The ejector-type refrigeration cycle 10 may not even be for a vehicle but may be applied to a stationary air conditioner, a cool storage, or the like.

What is claimed is:

1. An ejector-type refrigeration cycle comprising:

a compressor that compresses a refrigerant and discharges the refrigerant, the refrigerant being mixed with a refrigerant oil;

a radiator that causes the refrigerant discharged from the compressor to radiate heat;

an ejector module having a body, the body providing a nozzle portion that reduces a pressure of the refrigerant flowing out of the radiator, a refrigerant suction port that draws a refrigerant as a suction refrigerant using a suction action of an injection refrigerant jetting out of the nozzle portion, a diffuser passage that mixes the injection refrigerant and the suction refrigerant and increases a pressure of the refrigerant, and a gas-liquid separating space that separates the refrigerant flowing out of the diffuser passage into a gas-phase refrigerant and a liquid-phase refrigerant;

an evaporator that evaporates the liquid-phase refrigerant separated in the gas-liquid separating space; and a controller programmed to:

control a refrigerant discharge capacity of the compressor; and determine whether a low pressure difference operating condition is met, the low pressure difference operating condition being defined as an operating condition in which a pressure difference obtained by subtracting a low-pressure side refrigerant pressure in the ejector-type refrigeration cycle from a high-pressure side refrigerant pressure in the ejector-type refrigeration cycle is equal to or lower than a predetermined reference pressure difference, wherein the body is provided with an oil return passage that guides a part of the liquid-phase refrigerant, which is separated in the gas-liquid separating space, to flow from the gas-liquid separating space to a suction side of the compressor, and the controller sets the refrigerant discharge capacity of the compressor to be higher than or equal to a predetermined reference discharge capacity when the low pressure difference operating condition is determined to be met, the predetermined reference pressure difference is a value at which the liquid-phase refrigerant separated in the gas-liquid separating space can be reliably returned to the suction side of the compressor through the oil return passage, and the predetermined reference discharge capacity is a value at which the liquid-phase refrigerant separated in the gas-liquid separating space can be reliably returned to the suction side of the compressor through the oil return passage.

2. The ejector-type refrigeration cycle according to claim 1, further comprising an outside air temperature detector that detects an outside air temperature, wherein the controller determines that the low pressure difference operating condition is met when a detection value of the outside air temperature detector is equal to or lower than a predetermined reference outside air temperature.

* * * * *